United States Patent [19]

Kajrup et al.

[11] Patent Number: 4,862,719

[45] Date of Patent: Sep. 5, 1989

[54] CYLINDER FLANGING MACHINES

[75] Inventors: Göran Kajrup; Göran Bjerke, both of Hassleholm, Sweden

[73] Assignee: Comeq, Inc., Baltimore, Md.

[21] Appl. No.: 146,277

[22] Filed: Jan. 20, 1988

[51] Int. Cl.[4] ..... B21D 19/04

[52] U.S. Cl. ..... 72/105; 72/334; 72/111

[58] Field of Search ..... 72/86, 94, 101, 111, 72/125, 334, 102, 105

[56] References Cited

U.S. PATENT DOCUMENTS

| | | | |
|---|---|---|---|
| 317,145 | 5/1885 | Kollberg | 72/111 |
| 582,863 | 5/1897 | Jones | 72/101 |
| 758,145 | 4/1904 | Nordenskjold | 72/101 |
| 802,804 | 10/1905 | Enright | 72/111 |
| 1,219,174 | 3/1917 | Sessions | 72/105 |
| 1,268,239 | 6/1918 | Gressle | 72/111 |
| 1,634,057 | 6/1927 | Taylor | 72/111 |
| 1,807,824 | 6/1931 | Booth | 72/334 |

FOREIGN PATENT DOCUMENTS

| | | | |
|---|---|---|---|
| 244832 | 3/1912 | Fed. Rep. of Germany | 72/105 |
| 18201 | of 1916 | United Kingdom | 72/105 |
| 1202144 | 8/1970 | United Kingdom | 72/86 |

*Primary Examiner*—Robert L. Spruill

*Attorney, Agent, or Firm*—Samuel Lebowitz; Milton M. Field

[57] ABSTRACT

An integral outwardly extending transverse annular flange is formed on one or both extremities of a previously formed cylinder, circumferentially spaced circular openings are then punched in the one or both flanges. An adjustable expansible and freely rotary mandrel, adapted to grasp tightly the internal wall of the cylinder, is mounted adjacent to one end of a movable support which is pivotally mounted and movable relative to the base from a horizontal to a vertical position. A pair of cylindrical forming or tooling rolls on parallel vertical axes are mounted on the base. The axes of the inner roll, adjacent to the pivotal joint is fixed, while the axis of the outer roll is movable and operable under high pressure to clamp a small portion of the periphery of the lower extremity of the cylinder between the rolls, corresponding to the width of the flange. The simultaneous rolling of the tooling rolls and the rocking of the support from the horizontal to the vertical, with the concomitant rotary movement of the main portion of the cylinder from a vertical axis to a horizontal axis results in the formation of the flange in a vertical plane. When the support returns to a horizontal plane, a hole punch unit locked on the support separated from the cylinder during flanging is shifted into position to pierce a predetermined number of holes in the flange.

12 Claims, 10 Drawing Sheets

CYLINDER FLANGING MACHINES

This invention relates to a cylinder flanging machine adapted to form circular flanges extending at 90° from one or both ends of a previously rolled cylinder with the capability of punching a predetermined number of holes in one or both flanges, as desired.

It is the object of the present invention to provide a rugged and reliable machine adapted to economically form flanges on the ends of cylinders of different diameters and thicknesses of stock, in a matter of minutes. The invention is a marked improvement over the manufacture of flanged steel cylinders in the production of fan housings, water heaters, pressure vessels, or extended conduits serving many different purposes formed of joined flanged cylindrical sections. The inventive improvement avoids the need for cutting a circular flange from a flat steel bar, machining the annular flange to perfect circular form, punching holes in the flange and finally welding the flange onto a previously rolled cylinder, with the attendant tremendous waste of time and material.

It is another object of the invention to provide a flanging machine capable of rapid adjustment for cylinders of different sizes, and the production of a product characterized by a high factor of safety in consequence of the integral construction of the cylinder and flange components and the avoidance of the possibility of faulty and nonuniform welded joints.

Other objects and purposes will appear from the detailed description of the invention following hereinafter, taken in conjunction with the accompanying drawings, wherein FIG. 1 is a front elevation of the combining flanging and punching machine in accordance with the invention:

Figure 4:
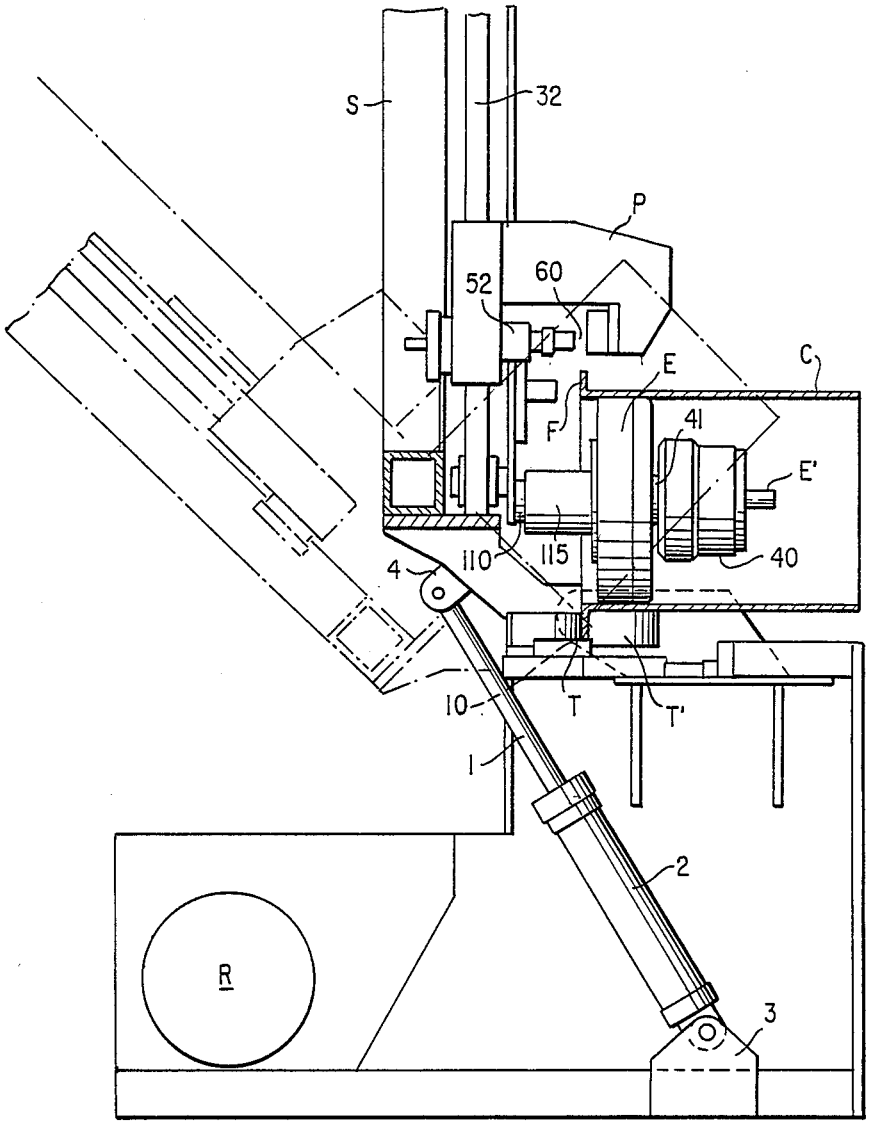
FIG. 4 is a front elevation of the base of the machine at the right of FIG. 1 with the movable outboard support pivoted thereto, in its final position, with an intermediate position indicated in dotted lines.
Figure 5:
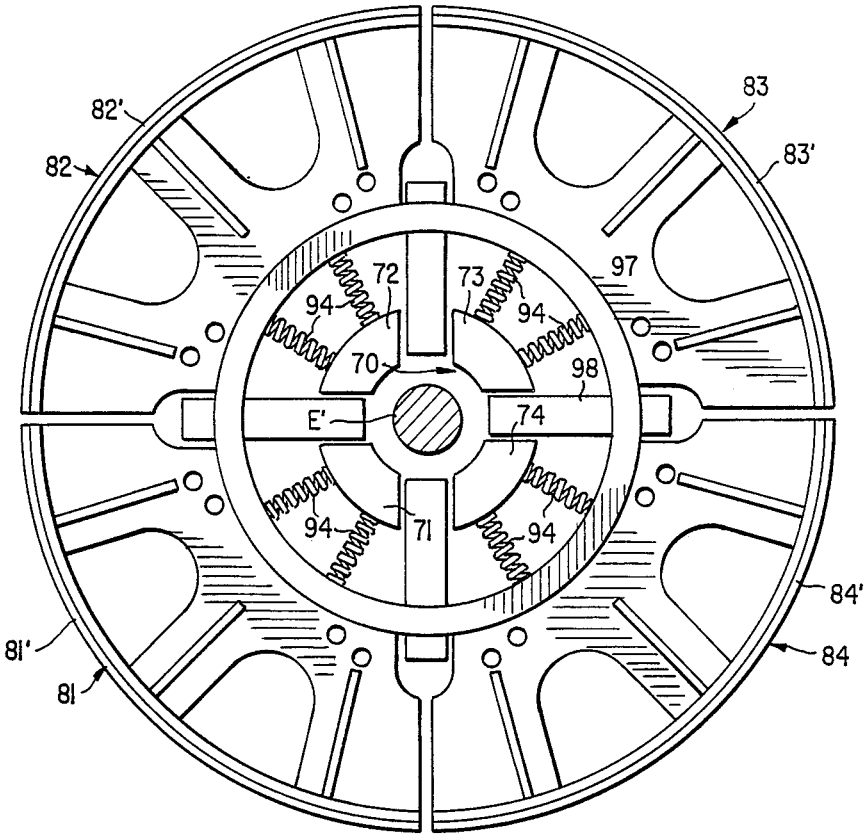
FIG. 5 is a plan view of the expander, with parts removed, of four adjustable quadrants for grasping the internal wall of the cylinder above the flange area.
Figure 5A:
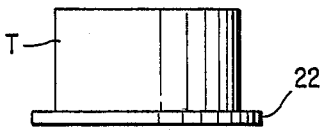
Figure 5B:
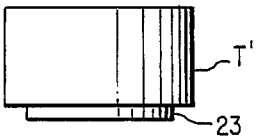
Figure 5C:
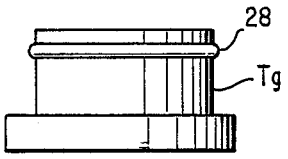
Figure 5D:
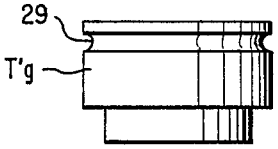
Figure 6:
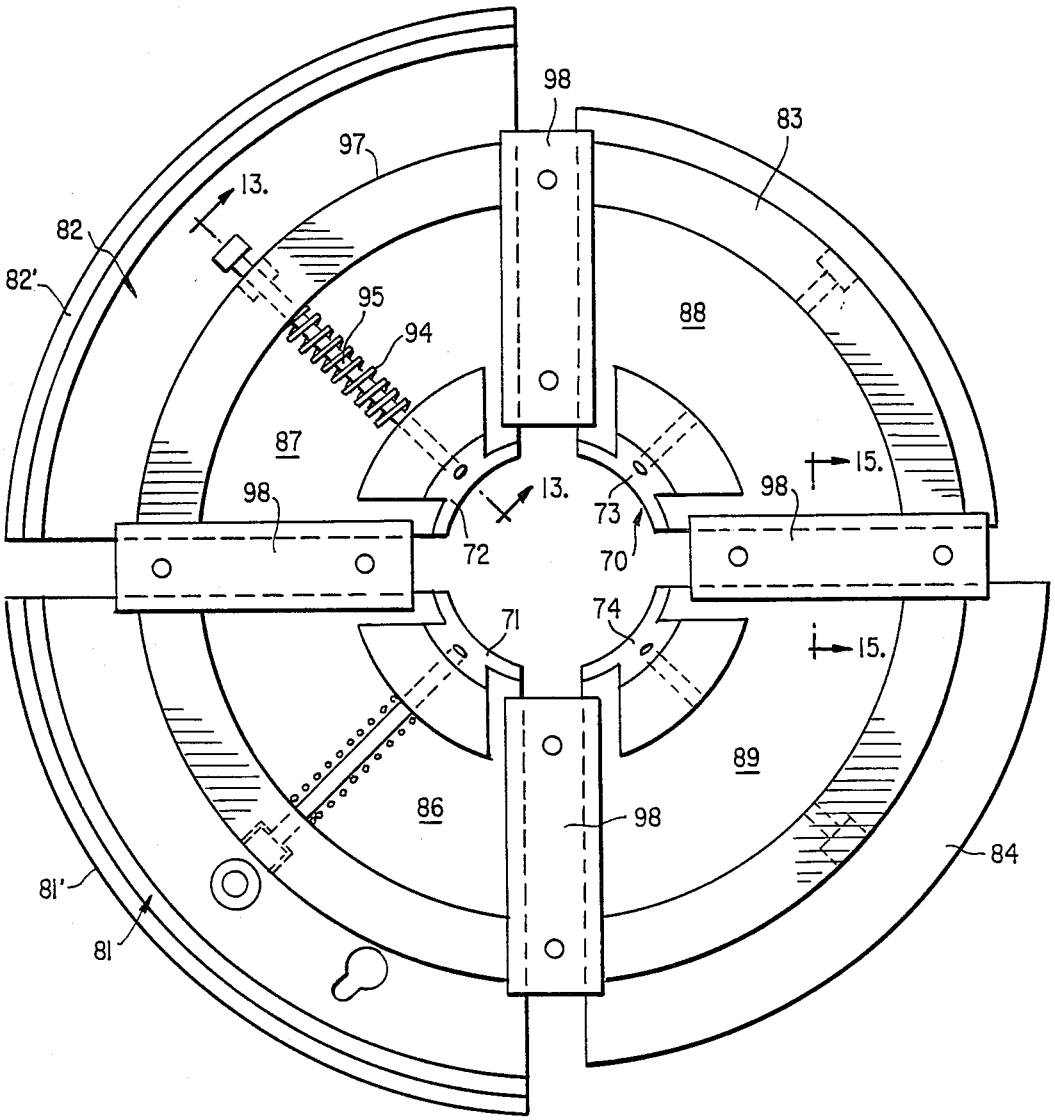
Figure 7:
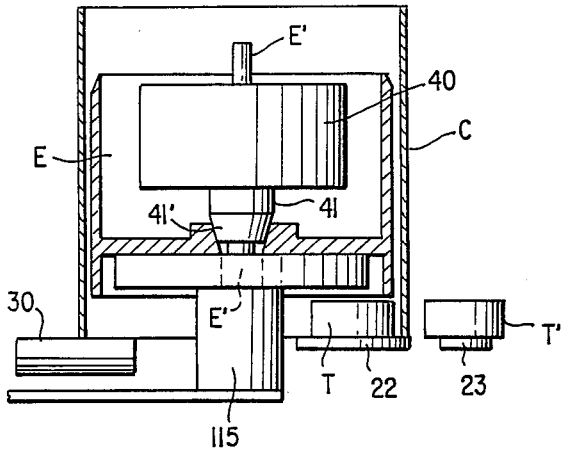
Figure 8:
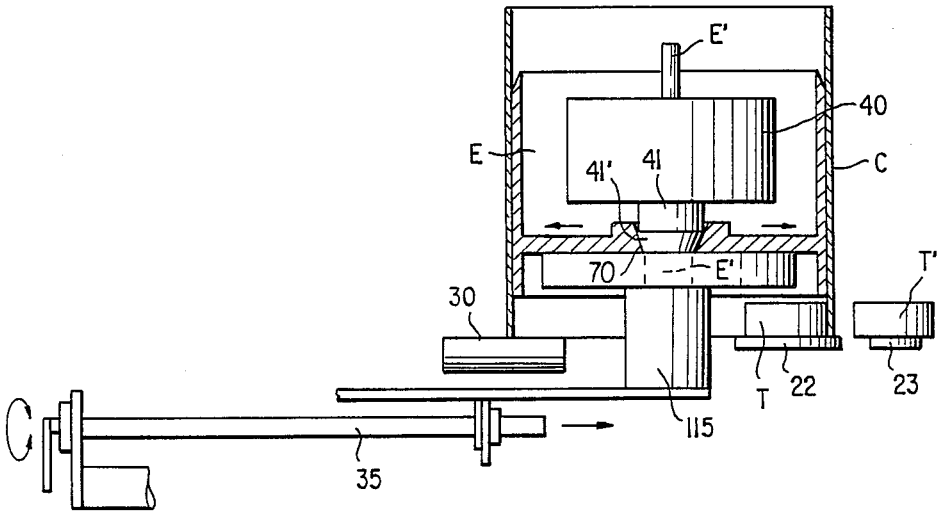
Figure 9:
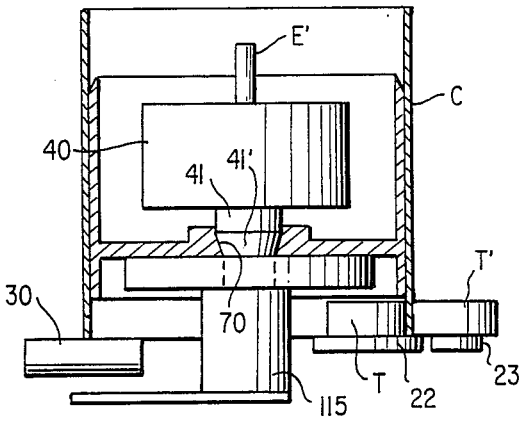
Figure 10:
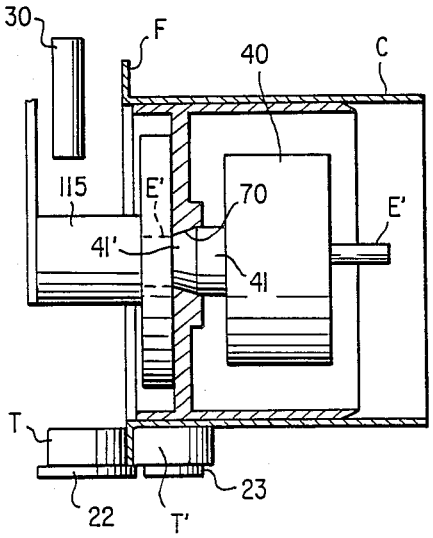
Figure 11:
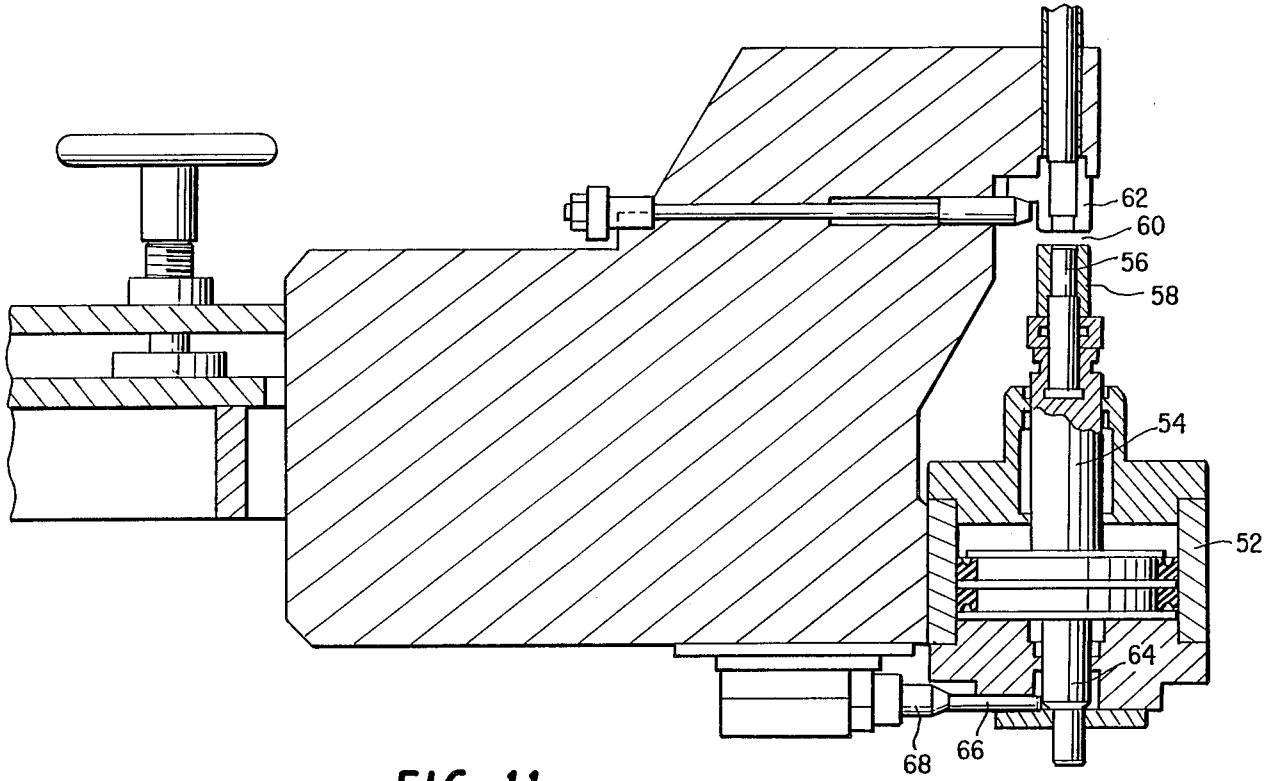
Figure 12:
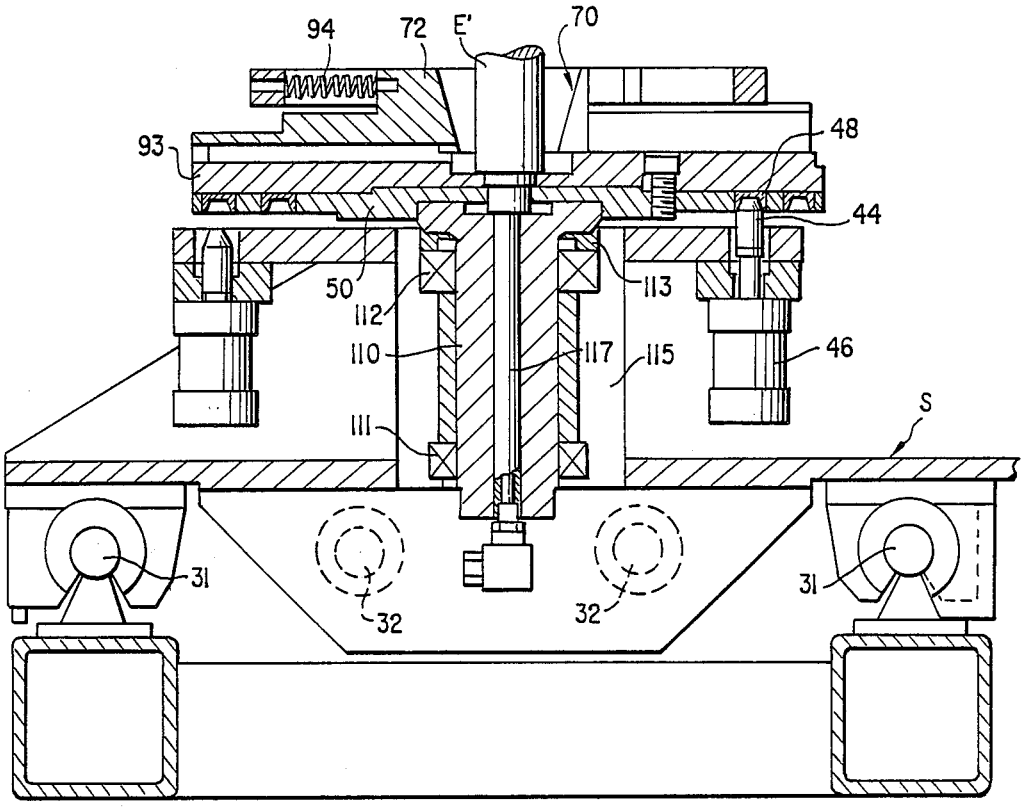
Figure 13:
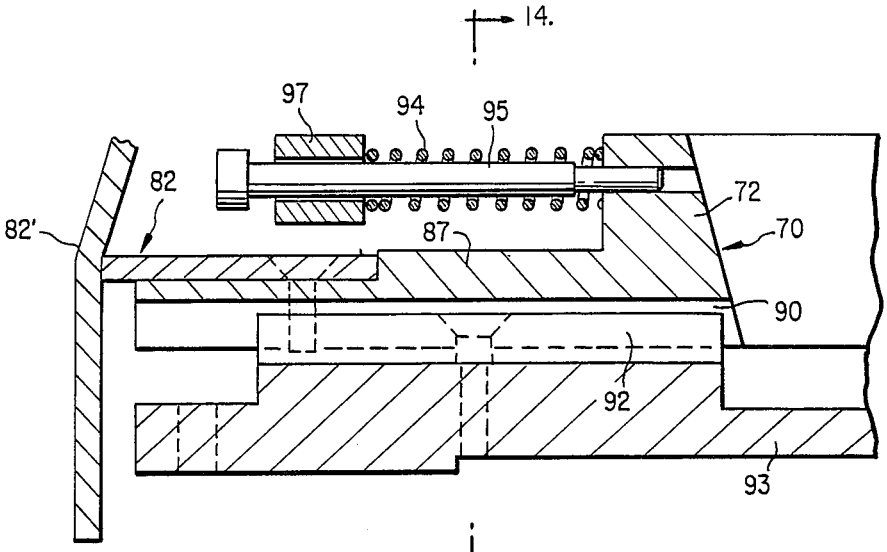
Figure 14:
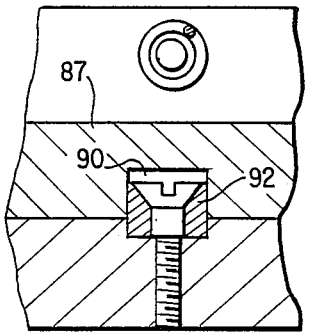
Figure 15:
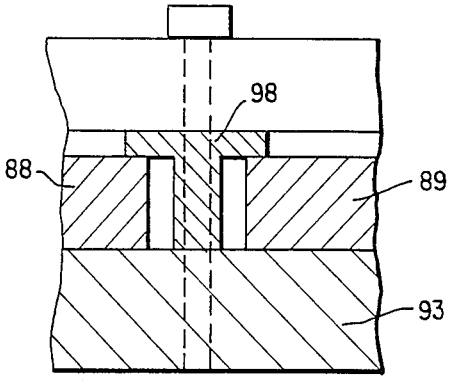

FIGS. 5*a* and 5*b* are front elevations of one set of forming or tooling rolls adapted to be driven by worm gear motors, for forming straight flanges;

FIGS. 5*c* and 5*d* are front elevations of a set of forming or tooling rolls for forming flanges with O-ring grooves therein;

FIG. 6 is a horizontal sectional view of the expander showing structural details and variants thereof other than those shown in FIG. 5;

FIG. 7 is a simplified vertical sectional view with some parts omitted for clarity and some parts in elevation, showing the expander or mandrel within the cylinder and the positioning of the latter preparatory to the flanging operation;

FIGS. 8 and 9 are views of the parts shown in FIG. 7 in later positions of the parts shown in FIG. 7;

FIG. 10 is a view showing the parts illustrated in FIG. 7 in the final position of the outboard support illustrated in FIG. 4;

FIG. 11 is a vertical sectional view of the operating end of the hole punching mechanism;

FIG. 12 is a transverse vertical sectional view of the outboard support with the rails thereon for movement of the expander, and also the punching mechanism to and from the completed flange, with control means on the bottom of the expander for selecting four different quantities of holes adapted to be punched in the flange;

FIG. 13 is a sectional view along line 13—13 of FIG. 6;

FIG. 14 is a sectional view along line 14—14 of FIG. 13;

FIG. 15 is a sectional view along line 15—15 of FIG. 6; and

Figure 16:
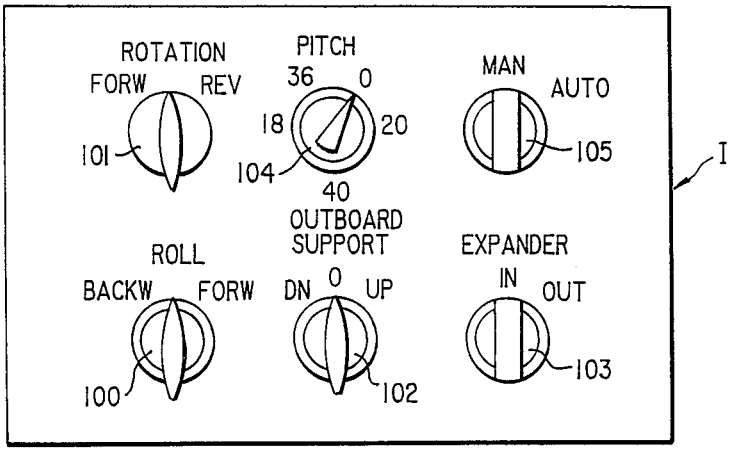

FIG. 16 is a plan view of the face of the control panel.

The drawings illustrate the combined flanging and punching machine, which despite its capabilities of handling heavy metal products, occupies relatively little factory floor space, approximately 10 ft. in length and 4 feet in width.

Figure 2:
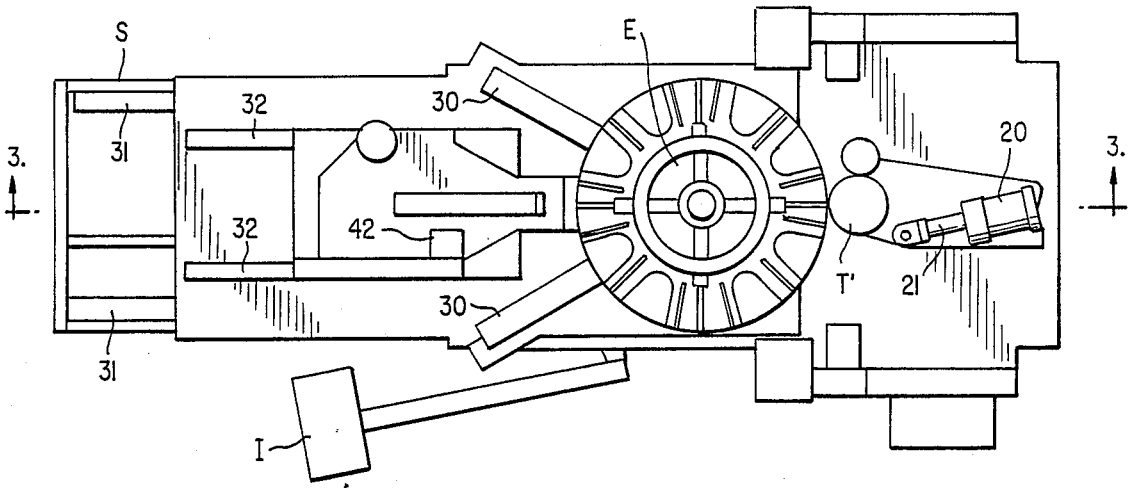
FIG. 2 is a plan view of FIG. 1.

An outboard support S is pivotally mounted to a stationary base B. The cylinder C to be flanged is mounted on a rotatable expander or expansible mandrel E adjacent to the pivotal joint of the support, which mandrel grasps the internal wall of the cylinder during the flanging and punching stages of operation. The expander calibrates or sizes the previously rolled cylinder into true circular section prior to flanging, and consequently much more accurate flanging is attained than is possible by any machines of the prior art, of which that shown in Pat. No. 4,117,704 Oct. 3, 1978, is illustrative. The mandrel expands on the inside of the cylinder to make possible even out-of-round cylinders to be flanged successfully and accurately. Differently sized expansible mandrels or expander dies, as shown in FIGS. 2, 5, and 6 are adapted to be mounted adjacent to pivotal end of the outboard support for retaining cylinders of different diameters, and the latter should be about $\frac{1}{4}''$ to $\frac{3}{8}''$ larger than the expander dies. The position of the expander adjacent to the pivotal joint of the support S is controlled by a threaded bolt 35 which is manipulatable from the outer end of the support S (FIG. 8). The expanding die is powered by a conical inner shaft and pneumatic cylinder 40, as seen in FIGS. 7–10. The shaft 41 is mounted on the piston of pneumatic cylinder 40 and has a conical head 41' which is received in an opening 70 (FIGS. 5–10) of expander E. Upon operation of cylinder 40, shaft 41 moves out of cylinder 40 into opening 70 which is formed by inner inclined bearing surfaces 71, 72, 73 and 74 of respective four quadrants 81, 82, 83 and 84 of expander E. The quadrants include carriers 86, 87, 88 and 89, the inner inclined ends 71, 72, 73 and 74 of which form opening 70. The carriers have guide grooves 90 riding on rails 92 mounted on turntable 93 and are biased inwardly by coil springs 94 mounted on rod 95, which extends through spring abutment ring 97. As shown in FIG. 5, two such bias springs 94 are used for each quadrant; but as illustrated in FIG. 6, only one such spring 94 may be used. The edges of the carriers are received in the guide grooves provided by guide members 98 (FIG. 15). Outer gripping members 81', 82', 83' and 84' are mounted on the respective carriers of quadrants 81, 82, 83 and 84. These gripping members, which are removably mounted on respective carriers, may extend different radial distances outwardly to accommodate cylinders C of different diameter. This is illustrated in FIG. 6 where quadrants 83 and 84 extend radially outwardly distances which are less than the radial extent of quadrants 81 and 82. Of course, when expander E is used, all of the quadrants extend outwardly the same distance chosen to accommodate the diameter of the cylinder C to be flanged. By virtue of the conical surface, as shaft 41 moves into opening 70, quadrants 81, 82, 83 and 84 are moved outwardly to engage and grip the inner surface of cylinder C with outer gripping members 81', 82', 83' and 84'.

Figure 3:
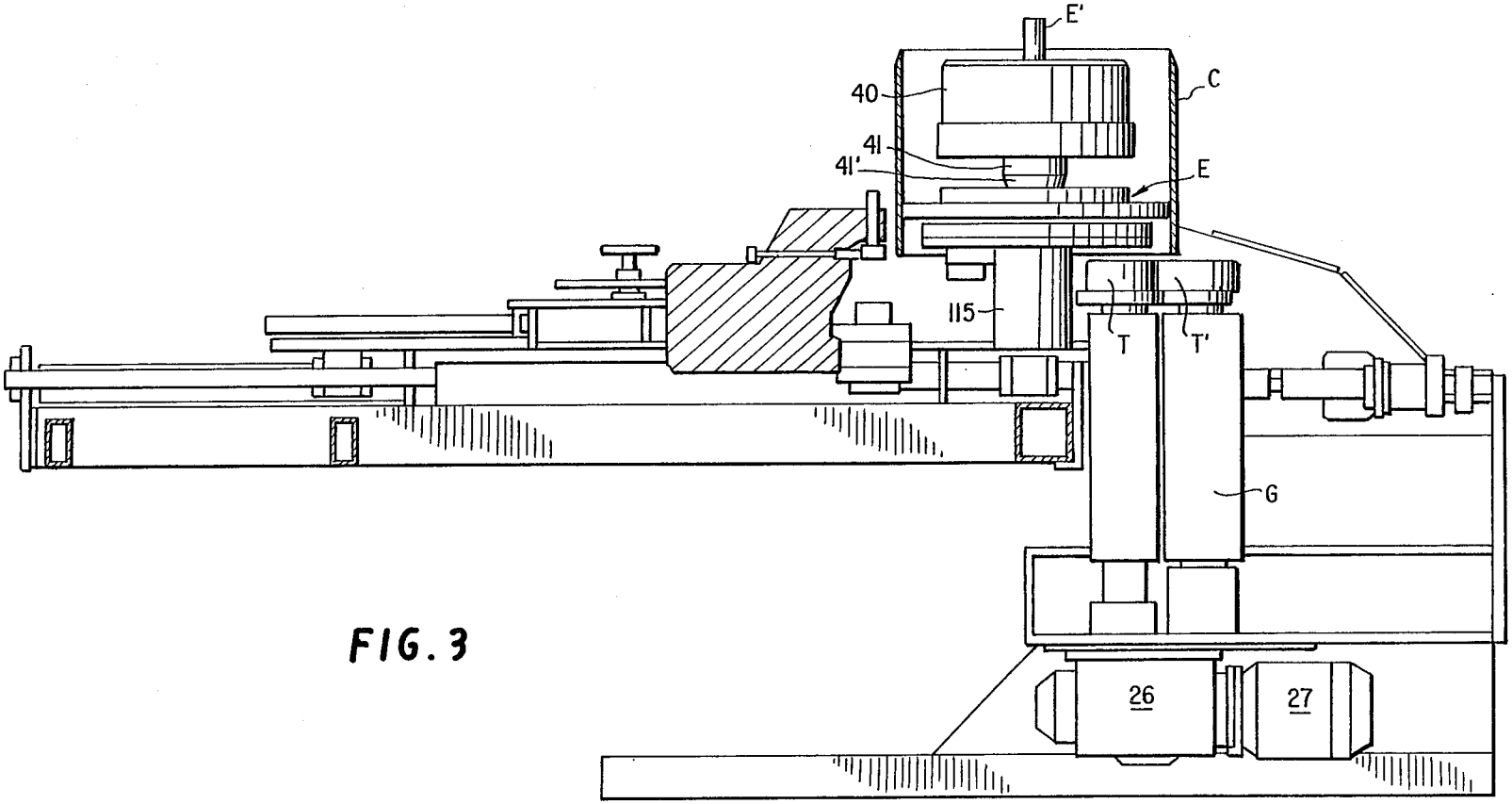
FIG. 3 is a vertical sectional view along line 3—3 of FIG. 2.

As shown in FIGS. 3, 4, and 12, cylinder 40 is mounted on axle E' which rotates with shaft 110. Shaft 110 is mounted for rotation by bearings 111, 112 and 113 which, in turn, are supported by bearing housing 115, mounted on support S so that expander E is freely rotatable. For its part, shaft 41 slides on axle E' as it moves to or from cylinder 40. The pneumatic fluid for cylinder 40 is provided through a tube 117 running along the axis of shafts 110 and E' to cylinder 40.

Figure 1:
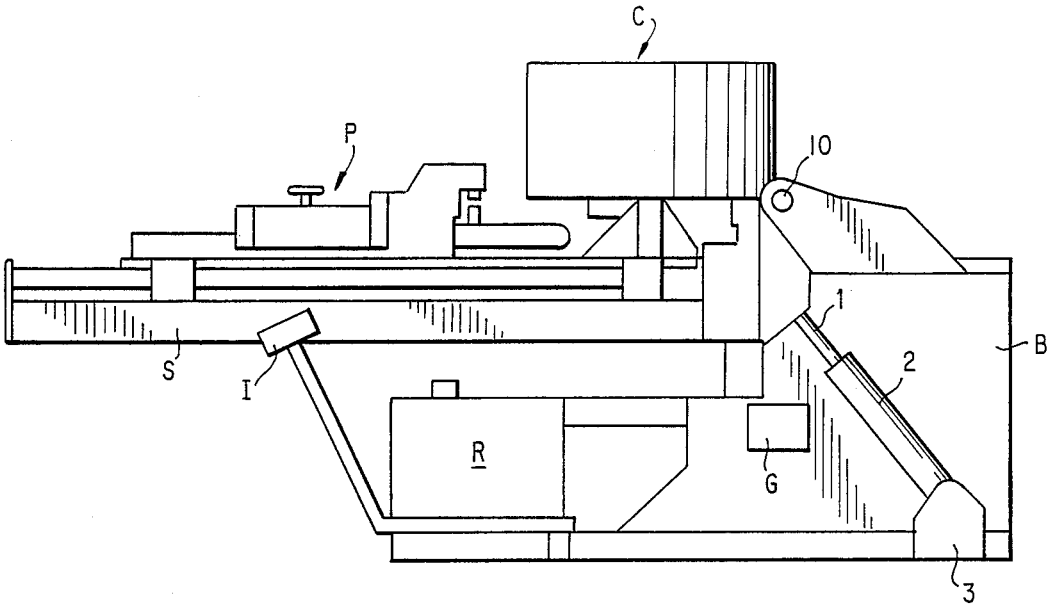

The support S is positionable between its horizontal position shown in FIGS. 1–3 to its final position shown in FIG. 4, by rotation on its axis 10, as a consequence of the gradual extension of each piston 1 from its hydraulic cylinder 2 on each side of the machine base. The upper end of each piston is connected to a bracket 4 on the support, while the lower end of each cylinder 2 is connected to a bracket 3 near the outer end of the base B. The oil reservoir for the hydraulic system is provided in chamber R.

A pair of forming or tooling rolls T and T' are mounted on the top of the base B, along the longitudinal axis of the base and support. The vertical axis of inner roll T is stationary while the vertical axis of the outer roll is movable along said longitudinal axis and is operable, as seen in FIG. 2, by hydraulic cylinder 20 and piston 21 extending therefrom to roll T'.

Worm gearing G, operated by an electric motor 27 and gear box 26 serves to drive the tooling rolls T and T' at high power.

FIGS. 5*a* and 5*b* show a set of tooling rolls T and T' for rolling a flat transverse flange. The roll T is provided with a flange 22 at the bottom, whereon is adapted to be set the outermost portion of the extremity of the cylinder C. A groove 23 at the bottom of the movable roll T' may interfit with the flange 22. Two sets of such rolls are provided with a machine, the vertical dimensions of the lateral wall of one set being 78.5 mm. and 77.5 mm. for T and T' respectively and 63.5 mm. and 62.5 mm. and 62.5 mm. for the other set.

FIGS. 5*c* and 5*d* show a modified set of tooling rolls Tg and Tg' for rolling a grooved flange for accommodating a sealing O-ring. A ridge 28, in the stationary roll cooperates with a groove 29 in the movable roll to form this groove in the flange. The vertical dimensions of these sets above the respective bottom flanges and grooves may be 63.8–62.8 and 58.8–58.3 mm. respectively.

Rails 31 on the top of the outboard support permit ready movement of the expander along the latter and rails 32 permit movement of the punching machine from an outer inactive position to one adjacent to the expander and overlying the flange for punching holes in the latter, either manually or automatically in conjunction with a foot switch Switching console I (FIG. 16), carries most of the switches for the operation of the machine. Switch 100 controls the forward or backward movement of the forming or tooling roll T'. The direction of rotation of the tooling rolls T, T', including their rest positions, is controlled by switch 101. Switch 102 controls the up and down movements of the outboard support, and switch 103 controls the in and out movements of the expander E. Switch 104 sets the pitch for four different numbers of holes to be punched by the punching mechanism P, when automatic operation is selected as controlled by switch 105 and, as shown in FIG. 16, may, for example, be 18, 36, 20 and 40 in number.

The capabilities, parameters and technical data of the machine described above, the "ROUNDO" S-3, of an intermediate size, are as follows:

| | |
|---|---|
| Drive motor | 5.5 Hp |
| Pump motor | 5.5 Hp |
| Rolling speed | 14 m/min |
| Maximum plate thickness that can be flanged | 6.5 mm. |
| Minimum cylinder dia. that can be flanged | 500 mm. |
| Maximum cylinder dia. that can be flanged | 1500 mm. |
| Maximum cylinder height about | 2000 mm. |
| Minimum cylinder height in combination with punching of both flanges, distance flange to flange | 200 mm. |
| Maximum dia. of the circle on which holes can be punched | 1545 mm. |
| Number of holes | 18/36, 20/40 |

The machine operates as follows:

The previously rolled and welded cylinder C is placed on the machine around the expander E and is made to rest upon the flange 22 of tooling roll T and support rolls 30 (FIGS. 2, 7 and 8). The expander is then expanded to hold the cylinder in place for the entire flanging and punching operation (FIG. 8). The expander is pneumatically operated, and rotates freely on its axis E'. The outboard support S is then adjusted using the adjusting screw 35 to move the edge of the cylinder against the fixed roll tooling T. After this is done, the rotation is started by operating switch 101. Then the movable roll T' is brought up against the cylinder by operating switch 100. The pressure applied by this movable roll is adjusted by a hydraulic pressure forming roll control knob (not shown) according to the thickness of the cylinder plate. For such ⅛", 3/16" and ¼", the recommended pressures on the forming roll are 35, 50 and 75 bars, respectively. These pressures can be read on a gauge (not shown). After two or three complete revolutions with the forming roll in place, the outboard support can begin its rise to the vertical position. This is done by operating switch 102 and the speed of the climb is controlled by a gauge (not shown). As the outboard support approaches vertical, a limit switch will stop the climb at 90°. At this point, the flange has been formed, as shown in FIG. 4. Thereafter, the forming roll is retracted by operating switch 100, the rotation is stopped by by operating switch 101 and the outboard support is lowered by operating switch 102. Now the flange is ready to be punched.

The hole punching mechanism P, best seen in FIGS. 4 and 11, is locked in place by an air cylinder, shown at 42 in FIG. 2, on the outboard support S during the flanging operation. When the flanging is completed and the outboard support is once again horizontal, the punch unit can be moved into place along the outboard support. Air cylinder 42 locking the punch unit in place is retracted using a pneumatic valve. The punch unit is then moved until (see FIG. 12*a*) pin 44 on an air cylinder 46 seats itself in a pre-drilled hole 48 on the bottom of expander E, which sets the proper pitch diameter for the holes of the particular cylinder being flanged and punched.

The operator can select one of four hole quantities to be punched in the flange by operating the switch 104 on the control panel I (FIG. 16). The bottom side of the expander has a plate 50 that contains four rows of pins and four rows of drilled holes, which correspond to the four different hole quantities. There are proximity switches, one for each row of pins. Switch 104 controls a circuit (not shown) which enables a selected proximity switch sensing pins for a row of drilled holes corresponding to the number selected. In "automatic" mode of switch 105 (FIG. 16), the operator rotates the flanged cylinder, and when the proximity switch corresponding to the selected hole quantity senses a pin, it causes a pneumatic cylinder 46 to fire, and the cylinder rod 44 enters one of the drilled holes 48, locking the flanged cylinder in place for the punching operation. Then the operator steps on the foot pedal (not shown), activating the punch P. The punch is a conventional hydraulic cylinder actuated punch and, as shown in FIG. 11, includes a hydraulic cylinder 52, a piston 54 for driving a punch head 56 through a stripper 58. The flange formed on cylinder C is aligned with the gap 60 in the punch unit as shown in FIG. 4 so that when punch unit is moved to its punching position, flange F is positioned in gap 60. When the punch is actuated, piston 54 projects punch head 56 through flange F in gap 60 entering die 62 to punch a hole in flange F. When the punch cylinder retracts, the lower end 64 shoves a switch actuating rod 66 laterally to actuate a microswitch 68. This causes the air cylinder rod 44 to retract from the drilled hole 48, allowing the operator to rotate the flanged cylinder to the next location for a punched hole.

After all the holes are punched, the punch unit is moved back to its parked or locked position, and the flanged cylinder can be removed. This is done by turning switch 103 which allows the expander to contract, releasing the cylinder. The flanged cylinder can be turned end for end and remounted on the expander in order to form a flange on the other end.

The machine described above may be made in various sizes to meet diverse manufacturing needs. The technical data for a number of examples follows:

Technical Data for Model S-1 is as follows:

Diameter of the two flanging rolls - 4.33"
Maximum diameter of cylinder that can be flanged - 48"
Minimum diameter of cylinder that can be flanged - 13¾"
Maximum flange width - 2"
Minimum flange width - 9/16" (depending on plate thickness)
Maximum plate thickness - 0.156" mild steel
Minimum plate thickness - 0.040" mild steel
Maximum cylinder height (depending on diameter and thickness) - 40"
Minimum cylinder height - 8" (before flanging)
Rolling speed - about 30' per minute
Total connected power - 5½ Hp Punching device:

Hole punching diameter range in maximum plate thickness ¼" to 9/16"
Number of holes that can be punched - select 2 or 4 ranges between 6 and 48 holes according to customer's specifications;
Typical flanging time for one flange for cylinder diameter 28" - 3 minutes Technical Data for Model S-2 is as follows:

Diameter of the two flanging rolls - 5.12"
Maximum diameter of cylinder that can be flanged - 60"
Minimum diameter of cylinder that can be flanged - 18"
Maximum flange width - 2⅜"
Minimum flange width - 9/16" (depending on plate thickness)
Maximum plate thicknesss - .062" mild steel -continued Maximum cylinder height (depending on diameter and thickness - 60"
Minimum cylinder height - 10" (before flanging)
Rolling speed - about 40' per minute
Total connected power - 7.5 Hp Punching device:

Hole punching diameter range in maximum plate thickness 1/4" to 9/16"
Number of holes that can be punched - select 2 or 4 ranges between 6 and 48 holes according to customer's specifications;
Typical flanging time for one flange for cylinder diameter 28"- 3 minutes Technical Data for Model S-4 is as follows:

Diameter of the two flanging rolls - 7.48"
Maximum flange width - 3.25"
Minimum flange width - 9/16" (depending on plate thickness)
Maximum plate thickness - 3/8" in steel with maximum 50000 PSI yield point
Minimum plate thickness - 080"
Maximum cylinder height - 72", at 3/8" wall thickness and 30" maximum diameter
Minimum cylinder height - 12"
Minimum distance from flange to nearest part protruding from cylinder diameter (in order for clear punching unit) - 10"
Rolling speed - about 40' per minute
Working range of expanding die - ±⅜"
Total connected power - 15 HP
Flanging time for one flange for cylinder diameter 28" - 3 minutes
Maximum punching diameter in maximum plate thickness - 9/16"
Number of holes that can be punched - 18/20/36/40
Special switch-selectable hole quantity, with automatic indexing While the invention has been particularly shown and described, it will be understood by those skilled in the art that changes in form and details may be made therein without departing from the spirit and scope of the invention.

What is claimed is:

1. An apparatus for forming an integral outwardly extending annular flange at the lower extremity of a cylinder of malleable material comprising (a) a stationary base and a movable outboard support pivotally connected to said base at juxtaposed ends of said base and support, (b) means extending between said base and support for varying the inclination of said support between horizontal and vertical positions, (c) a freely rotatable expansible means on said support adjacent to its pivoted end for tightly grasping a portion of the internal wall of the cylinder above said lower extremity and to permit free rotary movement of the latter, (d) a pair of closely spaced opposed rotary roller means mounted on said base and in alignment with a longitudinal axis of said base and support and adapted to embrace a portion of the cylinder wall portion therebetween at the lower extremity of the latter, comprising an inner cylindrical tooling roll mounted on said base on a fixed vertical axis and an outer cylindrical tooling roll mounted on a vertical axis movable toward and away from said first tooling roll, (e) means for moving said outer rotary tooling roll tightly against the external wall of the cylinder opposite to the first roll adjacent to the internal wall of the cylinder, (f) heavy-duty drive means for rotating both of said cylindrical rolls about their respective axes, and (g) means for actuating said first-mentioned means to swing said movable support from a horizontal position to its vertical position at a predetermined rate while simultaneously rotating said rotary roller means to present successive portions of said cylinder at said extremity to the field of operation of said rotary roller means during the increasing inclination of said support relative to said base.

2. An apparatus as set forth in claim 1, including means for stopping the rotation of said drive means for said cylindrical rolls in response to the vertical positioning of said support.

3. An apparatus as set forth in claim 2, including means for releasing the clamping of the outer cylindrical roll from clamping position against the external wall of the cylinder following the stopping of the rotary movement thereof.

4. An apparatus as set forth in claim 3, including means for actuating said first-mentioned means to return said support to its horizontal position.

5. An apparatus as set forth in claim 4, including a punching mechanism mounted adjustably on said support for alternative positioning remotely from said pivotal connection during the formation of the flange and in overlying relation to the latter for punching circular openings therein following the return of said support to its horizontal position.

6. An apparatus as set forth in claim 1 wherein said first-mentioned means is a hydraulic cylinder having one end thereof connected to said base and a piston extending from the opposite end of the cylinder having the free end of said piston connected to said support.

7. An apparatus as set forth in claim 1 wherein said expansible means comprises four radially adjustable quadrants.

8. An apparatus as set forth in claim 7 wherein said expansible means is actuated by a conical inner shaft and a pneumatic cylinder.

9. An apparatus as set forth in claim 7, wherein said outboard support has an outer end remote from said justaposed end, and including control means for adjusting the initial position of said expansible means operable from the outer end of said outboard support.

10. An apparatus set forth in claim 1 wherein said heavy-duty drive means for the tooling rolls comprise motor-driven worm gearing.

11. An apparatus as set forth in claim 1 wherein said inner tooling roll is provided with a peripheral flange at the bottom thereof for supporting the outermost portion of the extremity of the cylinder adapted to rest thereon, spaced supporting rolls on opposite sides of the longitudinal axis of the outboard support and at an inclination to said axis, adapted to provide rests for widely spaced points of said extremity remote from said outermost portion, and a circumferential groove at the bottom of said outer tooling roll for interfitting engagement with said peripheral flange on said inner roll.

12. An apparatus as set forth in claim 11 wherein said inner roll is provided with a rounded circumferential ridge in the lateral wall thereof adjacent to its upper edge and the outer roll with a rounded groove of corresponding cross-section to jointly form a recessed annulus of semi-circular cross-section in the outer face of the finished flange for the accommodation of a sealing O-ring therein between coupled flanges.

* * * * *

UNITED STATES PATENT AND TRADEMARK OFFICE

CERTIFICATE OF CORRECTION

PATENT NO. : 4 862 719

DATED : September 5, 1989

INVENTOR(S) : GORAN KAJRUP and GORAN BJERKE

It is certified that error appears in the above-identified patent and that said Letters Patent is hereby corrected as shown below:

In the Specification:

Col. 4, line 64, "12a)" is changed to -- 12) a --.

In the Abstract:

Line 3, -- and -- is inserted before "circumferentially".

Signed and Sealed this

Twenty-first Day of August, 1990

*Attest:*

HARRY F. MANBECK, JR.

*Attesting Officer*

*Commissioner of Patents and Trademarks*